US005784972A

United States Patent [19]

Emalfarb et al.

[11] Patent Number: 5,784,972

[45] Date of Patent: Jul. 28, 1998

[54] STAND FOR SUPPORTING ARTICLES

[76] Inventors: Bradley Emalfarb, 763 Bunker Ct.; Seymour Emalfarb, 1585 Saunders Rd., both of Riverwoods, Ill. 60015

[21] Appl. No.: 714,187

[22] Filed: Sep. 16, 1996

[51] Int. Cl.[6] ..... A47B 3/06

[52] U.S. Cl. ..... 108/156; 108/157.13; 108/159.11; 248/150

[58] Field of Search ..... 108/153, 159, 108/156, 157, 91, 150; 248/150, 151, 188

[56] References Cited

U.S. PATENT DOCUMENTS

| | | | |
|---|---|---|---|
| Re. 28,244 | 11/1974 | Evans | 108/157 |
| 2,768,044 | 10/1956 | Jaffe | 108/156 |
| 2,828,175 | 3/1958 | Barkules | 108/156 |
| 3,316,864 | 5/1967 | Maslow | 108/153 X |
| 3,696,763 | 10/1972 | Evans | 108/157 |
| 4,338,867 | 7/1982 | Imber | 108/159 |
| 4,627,543 | 12/1986 | Nicely | 108/156 X |
| 4,901,959 | 2/1990 | Stage | 248/150 X |
| 5,287,800 | 2/1994 | Orednick | 248/150 X |

FOREIGN PATENT DOCUMENTS

| | | | |
|---|---|---|---|
| 674881 | 10/1929 | France | 108/159 |
| 74567 | 12/1960 | France | 108/153 |
| 1425784 | 12/1965 | France | 108/153 |
| 427169 | 6/1967 | Switzerland | 108/156 |
| 856392 | 12/1960 | United Kingdom | 108/156 |

*Primary Examiner*—James R. Brittain
*Assistant Examiner*—Hanh V. Tran
*Attorney, Agent, or Firm*—Wood, Phillips, VanSanten, Clark & Mortimer

[57] ABSTRACT

A stand for supporting articles in an elevated position on a subjacent surface, which stand has a shelf with a support surface for an article, a base, and first structure cooperating between the base and shelf for allowing selective placement of the base and shelf in a) an operative state wherein the shelf is stably supported on the base so that the support surface is in an elevated position relative to a subjacent surface on which the base is placed, and b) a disassembled state wherein at least a part of the shelf is separated from the base. The first structure allows the shelf and base to be releasably maintained in a predetermined relative position in the operative state without the need for separate fasteners. The first structure includes a socket on one of the base and the at least part of the shelf and a post on the other of the base and the at least part of the shelf that is extendable into the socket by translating one of the base and the at least part of the shelf relative to the other of the base and the at least part of the shelf in a substantially linear predetermined path.

18 Claims, 2 Drawing Sheets

STAND FOR SUPPORTING ARTICLES

BACKGROUND OF THE INVENTION

1. Field of the Invention

This invention relates to stands for supporting articles in an elevated position relative to a subjacent support surface and, more particularly, to a stand that can be reconfigured to facilitate storage and transportation thereof.

2. Background Art

Stands are used for displaying a wide range of articles, such as plants. In one typical plant stand construction, a shelf, with an upwardly facing article support surface, is constructed from formed wire. Wire legs are welded to the shelf to define a fixed configuration.

It is common to package each such stand in its own container. While the stand itself accounts for little mass, the outline which must be accommodated by the container may become relatively large. Since this type of stand is a relatively low cost item, sales may be made in high volume. Accordingly, large amounts of storage space may be required by the manufacturer and at the point of purchase to accommodate these stands. Physical handling of these potentially large containers is also inherently difficult, even though the containers with the stands are relatively light in weight. Further, shipping costs associated with the packaged stands may be relatively high by reason of their large mass.

It is known to construct reconfigurable stands to allow compacting of the outline thereof. For example, reconfigurable stands are shown in each of U.S. Pat. Nos. 37,070, to Crawford; 440,554, to Fisher; 633,241, to Stone; 2,591,362, to Koch; 2,794,554, to Donner; 3,182,613, to Hagen; 3,538,862, to Patriarca; and 3,789,778, to Brand. Certain of these patents demonstrate that so long as the relatively movable parts remain connected to each other in both display and collapsed states, the amount of reduction of the volume of the entire stand outline is limited.

SUMMARY OF THE INVENTION

In one form of the invention, a stand is provided for supporting articles in an elevated position on a subjacent surface, which stand has a shelf with a support surface for an article, a base, and first structure cooperating between the base and shelf for allowing selective placement of the base and shelf in a) an operative state wherein the shelf is stably supported on the base so that the support surface is in an elevated position relative to a subjacent surface on which the base is placed, and b) a disassembled state wherein at least a part of the shelf is fully separated from the base. The first structure allows the shelf and base to be releasably maintained in a predetermined relative position in the operative state without the need for separate fasteners. The first structure includes a socket on one of the base and the at least part of the shelf and a post on the other of the base and the at least part of the shelf that is extendable into the socket by translating one of the base and the at least part of the shelf relative to the other of the base and the at least part of the shelf in a predetermined path.

In one form, the one of the base and the at least part of the shelf having the post is defined at least in part by wire, with the wire having a cantilevered portion defining the post.

In one form, the first structure includes first and second posts and first and second sockets for releasably receiving the first and second posts, with there being at least one of a) two posts, b) one post and one socket, and c) two sockets on each of the at least part of the shelf and the base.

In one form, the first and second posts are elongate and each have a lengthwise central axis, with the sockets each having an opening with a central axis. With the base and shelf in the operative state, the central axis of each of the first and second posts is substantially parallel to the central axis of the opening in one of the sockets.

In one form, with the base and shelf in the disassembled state, the central axes of the first and second posts are one of a) parallel to each other and b) at a first angle with respect to each other and the axes of the openings in the first and second sockets are one of c) parallel to each other and d) at a second angle with respect to each other, with the central axes of the first and second posts and the openings in the first and second sockets being arranged so that the axes of the first and second posts are not alignable to be parallel to each other and to both of the central axes of the openings in the first and second sockets with the base and shelf in the disassembled state.

In one form, with the base and shelf in the disassembled state, the central axes of the posts are not alignable with the central axes of the openings in the sockets and at least one of the base and the at least part of the shelf is reconfigurable to allow the central axes of the first and second posts to be aligned with the central axes of the openings in the first and second sockets and directed into the openings in the first and second sockets as the base and shelf are changed from the disassembled state into the operative state.

The base may have a leg with first and second elongate elements, with there being one of the posts and sockets on each of the elongate elements.

The first and second elongate elements may be movable relative to each other transversely to the length of the first and second elongate elements to align the central axes of the first and second posts with the central axes of the openings in the first and second sockets.

The first and second elongate elements may be made from a bendable material which bends to allow the first and second elongate elements to move relative to each other to align the central axes of the first and second posts with the central axes of the openings in the first and second sockets.

In one form, a substantial portion of each of the shelf and base is made from formed wire.

The base may have first and second legs and with the base and shelf in the disassembled state, the first and second legs are fully separated fiom each other and the at least part of the shelf.

A retainer ring can be provided for confining an article on the support surface of the shelf, with there being second structure cooperating between the retainer ring and at least one of the shelf and base for allowing the retainer ring and base to be placed selectively in a) an operative state wherein the retainer ring resides above the shelf and extends at least partially around an article situated on the support surface and b) a disassembled state wherein the retainer ring is fully separated from the base. The second cooperating structure may allow the retainer ring and base to be releasably maintained in a predetermined relative position in the operative state without the need for separate fasteners.

In one form, the second cooperating structure allows the retainer ring to be moved from its disassembled state into its operative state by effecting relatively translational movement between the retainer ring and base.

In another form of the invention, a stand is provided for supporting articles in an elevated position on a subjacent surface, which stand includes a shelf having a support surface for an article, a base, and first structure cooperating between the base and shelf for allowing selectively placement of the base and shelf in a) an operative state wherein the shelf is stably supported on the base so that the support surface is in an elevated position relative to a subjacent surface on which the base is placed and b) a disassembled state wherein at least part of the shelf is fully separated from the base. The first structure allows the shelf and base to be releasably maintained in a fixed predetermined relative position in the operative state without the need for separate fasteners.

In one form, at least part of the at least one of the base and the at least part of the shelf is reconfigurable from a normal state to an assembly state, with the first structure allowing the base and shelf to be moved from the disassembled state into the operative state with the at least part of the at least one of the base and the at least part of the shelf in the assembly state and preventing the base and shelf to be moved from the disassembled state into the operative state with the at least part of the at least one of the base and the at least part of the shelf in the normal state.

The at least part of the at least one of the base and the at least part of the shelf is bent from its normal state into its assembly state and with the base and shelf in the operative state the at least part of the at least one of the base and the at least part of the shelf tends to re-assume its normal state and as an incident thereof produces a force between the base and shelf that maintains the base and shelf in the operative state.

DETAILED DESCRIPTION OF THE DRAWINGS

Figure 1:
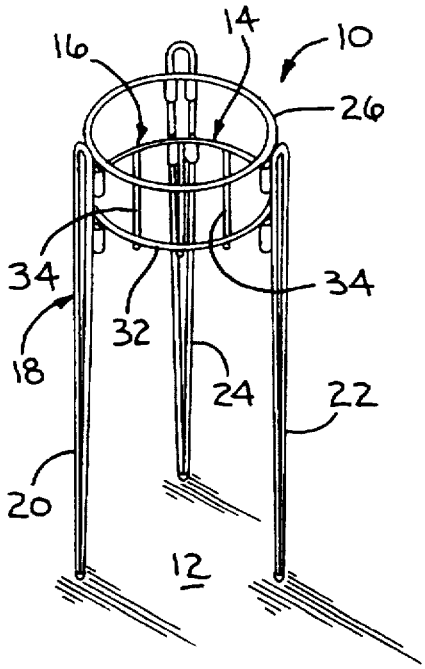
FIG. 1 is a perspective view of a stand for supporting articles, according to the present invention, with the stand in an operative state and situated on a subjacent support surface.
Figure 2:
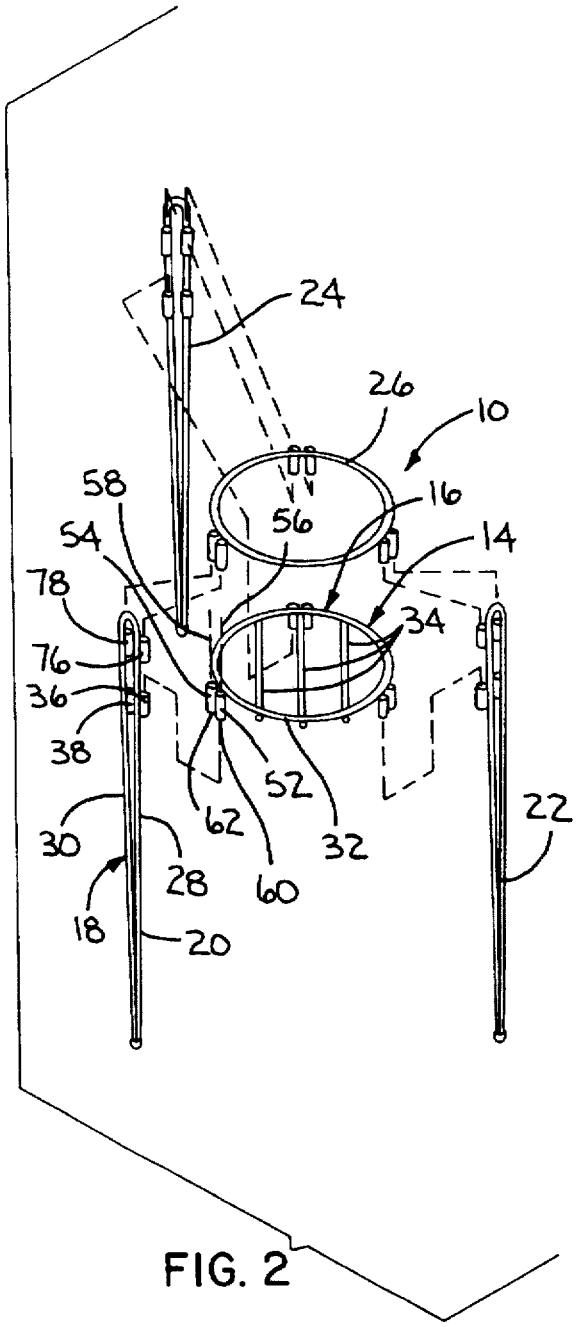
FIG. 2 is an exploded perspective view of the stand in FIG. 1 representing the disassembled state for the stand.

In FIGS. 1–4, one form of stand, according to the present invention, is shown at 10 for supporting an article (not shown) in an elevated position on a subjacent support surface 12. The stand 10 consists of a shelf 14, defining an upwardly facing support surface 16 for an article, and a base 18. Structure cooperates between the base 18 and shelf 14 for allowing selective placement of the base 18 and shelf 14 in a) an operative state, as shown in FIG. 1 wherein the shelf 14 is stably supported on the base 18 so that the support surface 16 on the shelf 14 is in an elevated position relative to the surface 12, and b) a disassembled state, as shown in FIG. 2 wherein the shelf 14 is fully separated from the base 18.

In the preferred embodiment, the base 18 is defined cooperatively by three legs 20, 22, 24 which are each releasably connected to the shelf 14 and a retainer ring 26. The exact number of legs is a design consideration. The retainer ring 26 is likewise placeable selectively in a) an operative state, as shown in FIG. 1 wherein the retainer ring 26 resides above the shelf 14 and extends at least partially around an article situated on the support surface 16 and b) a disassembled state, as shown in FIG. 2 wherein the retainer ring 26 is fully separated from the base 18.

With the stand 10 in the disassembled state of FIG. 2, the legs 20, 22, 24 can be stacked, one on top of the other, and the shelf 14 and retainer ring 26 situated so that the outline of the stand 10 occupies a significantly lesser volume than it does in the operative state of FIG. 1.

A substantial portion of each of the shelf 14, retainer ring 26, and base 18 is made from formed wire. A suitable wire has a metal core with a plastic or rubber coating thereon. Each leg 20, 22, 24 has the same configuration. Representative leg 20 has an inverted U shape with first and second elongate, vertically extending elements 28, 30. The shelf 14 has a ring 32 spanned by straight wire elements 34, which cooperatively define the support surface 16 for an article. The retainer ring 26 is defined by a single wire formed into a circular shape.

According to the invention, the retainer ring 26 and shelf 14 are each connected to the base 18 in such a manner that the shelf 14, retainer ring 26 and base 18 can be placed, and releasably maintained, in a predetermined relative position in the operative state without the need for separate fasteners and readily separated from each other. The shelf 14 is connected to each of the legs 20, 22, 24 in like fashion. Accordingly, the description herein will be limited to the representative connection between the shelf 14 and the leg 20.

Figure 7:
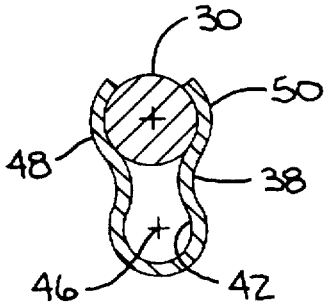
FIG. 7 cross-sectional view of a socket on the connection on a leg on the base taken along line 7—7 of FIG. 4.

Each of the elongate elements 28, 30 has a socket 36, 38 thereon defining a cylindrical opening 40, 42 with a vertically extending axis 44, 46. As seen clearly in FIG. 7, a preferred embodiment of the socket 38 has a U-shaped cross section with legs 48, 50 which conform, and are suitably adhered, to the elongate element 30, as by welding or the use of an adhesive. The opening 42 is located in spaced relationship to the elongate element 30.

Figure 4:
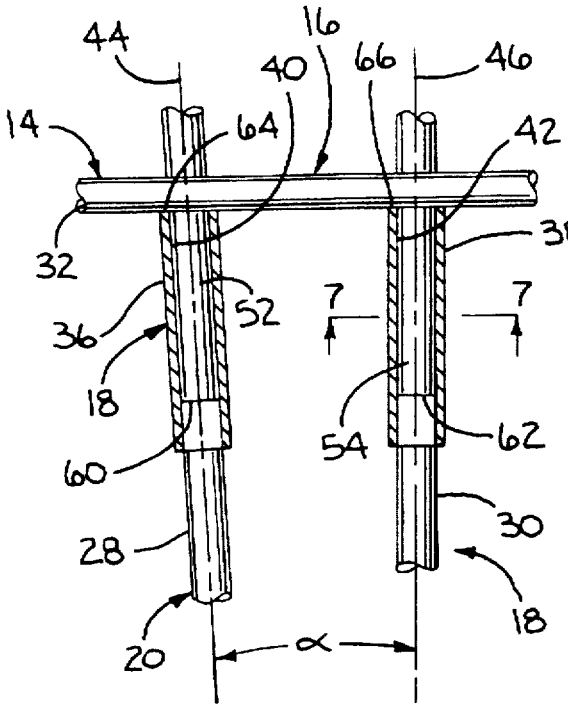
FIG. 4 is an enlarged, fragmentary, partial cross-sectional view of one connection between a support shelf on the stand and the base.

The shelf 14 has cantilevered, depending posts, 52, 54 formed of wire to be received one each in the openings 40, 42 in the sockets 36, 38. As shown in FIG. 4, the central axes 44, 46 of the openings 40, 42 align with the lengths of the elongate elements 28, 30 and make a slight angle $\alpha$ with respect to each other. The central axes 56, 58 of the posts 52, 54 can be parallel to each other, make the angle $\alpha$ with respect to each other, or make another angle with respect to each other that is different than the angle $\alpha$.

With the shelf 14 and leg 20 in a normal, undeformed state, the free ends 60, 62 of the posts 52, 54 are slightly misaligned with the upper entryways 64, 66 on the sockets 36, 38. This is a result of having the free ends 60, 62 spaced from each other either slightly greater or less than the spacing between the entryways 64, 66. As a result, the posts 52, 54 and/or the elongate elements 28, 30 with the sockets 36, 38 thereon must be reconfigured by moving them towards or away from each other to place them in an assembly state and thereby effect alignment between the posts 52, 54 and entryways 64, 66. This is permitted by the bendable nature of the wire defining the leg 20 and shelf 14.

By then pressing the posts 52, 54 downwardly into the openings 40, 42 in the sockets 36, 38, a friction fit between the posts 52, 54 and sockets 36, 38 is established. By simply effecting relative translational movement between the shelf 14 and leg 20, the posts 52, 54 are extendable fully into the sockets 36, 38 so that the shelf 14 and leg 20 are releasably maintained in a fixed predetermined relative position. The shelf 14 cooperates with the other legs 22, 24 in like fashion.

If the central axes 44, 46 of the sockets 36, 38 and the axes 56, 58 of the posts 52, 54 are parallel but not coincident with the shelf 14 and leg 20 in their normal state, the reconfigured shelf 14 and/or leg 20, upon the posts 52, 54 being extended fully into the sockets 36, 38, tends to re-assume its normal, undeformed state and in so doing produces a residual gripping force between the posts 52, 54 and sockets 36, 38.

Figure 3:
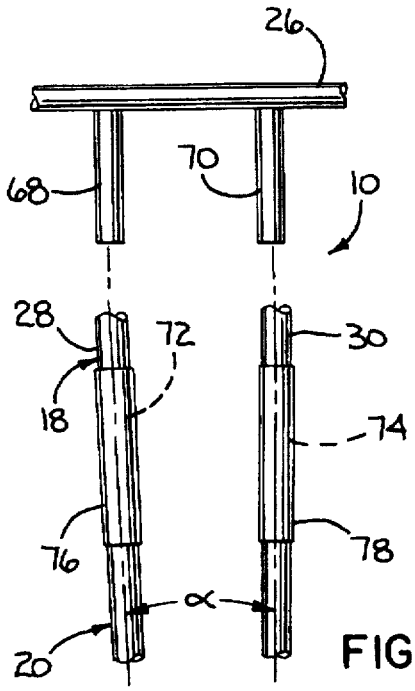
FIG. 3 is an enlarged, fragmentary exploded, elevation view of one connection between a retainer ring and a base on the stand.

The retainer ring 26 is also designed to be translated relative to the legs 20, 22, 24 to change the retainer ring 26 from the disassembled state in FIG. 2 to the operative state in FIG. 1. The retainer ring 26 has cantilevered posts 68, 70 made of wire and depending therefrom to project into openings 72, 74 defined by sockets 76, 78 on the elongate elements 28, 30. In FIG. 3, the posts 68, 70 are shown to be substantially parallel to each other to be press fit into the angularly oriented openings 72, 74 in the sockets 76, 78 in the same manner as the posts 52, 54 are directed into the openings 40, 42 in the sockets 36, 38. The posts 68, 70 and sockets 76, 78, by reason of being angularly misaligned, produce a torque on each other as the operative state is realized, and thereby enhance the frictional holding force therebetween. A similar connecting arrangement is provided between the retainer ring 26 and each of the other legs 22, 24.

Figure 5:
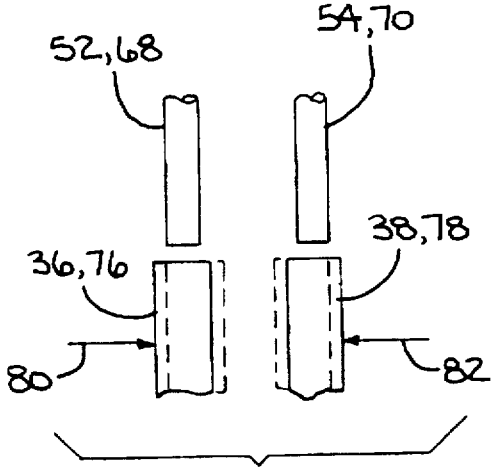
FIG. 5 is a schematic representation of a modified form of connection between the retainer ring and support shelf and the base, according to the present invention.
Figure 6:
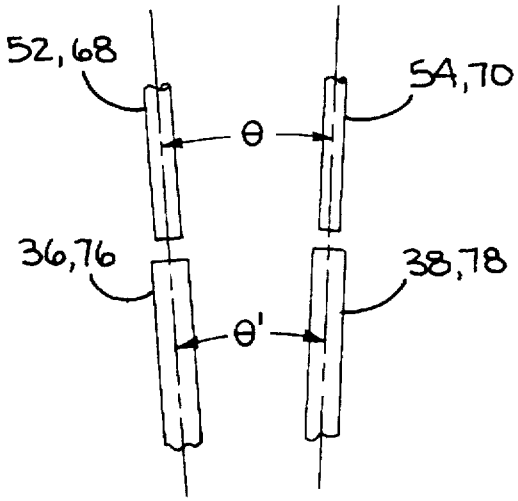
FIG. 6 is a view as in FIG. 5 of a still further modified form of connection according to the present invention.

Various other relationships between the posts 52, 54; 68, 70 and sockets 36, 38; 76, 78 are contemplated, as shown schematically in FIGS. 5 and 6. In FIG. 5, the posts 52, 54; 68, 70 are parallel to each other. The central axes of the openings defined by the sockets 36, 38; 76, 78 are parallel to each other and the central axes of the posts 52, 54; 68, 70. With this arrangement, the sockets 36, 38; 76, 78 must be shifted towards each other transversely to the length of the elongate elements 28, 30 to which they attach, as indicated by the arrows 80, 82, to allow the posts 52, 54; 68, 70 to be directed into the openings defined by the sockets 36, 38; 76, 78.

In FIG. 6, the central axes of the posts 52, 54; 68, 70 are at an angle θ with respect to each other, with the central axes of the openings defined by the sockets 36, 38; 76, 78 being at an angle θ1 with respect to each other. The angles θ, θ1 can be the same or different. In either event, deformation of the posts 52, 54; 68, 70 and/or the elongate elements 28, 30 is required to effect full seating of the posts 52, 54; 68, 70 in the openings defined by the sockets 36, 38; 76, 78.

The invention also contemplates that with the exemplary connection between the leg 20 and shelf 14, two posts, one post and one socket, or two sockets can be provided on each of the shelf 14 and leg 20. A similar arrangement is contemplated for the connection between the retainer ring 26 and the leg 20.

With the invention, the shelf 14, retainer ring 26 and base 18 can be consistently placed in the operative state of FIG. 1 and securely, releasably held in that state. By controllably deforming the shelf 14, retainer ring 26 and/or base 18, the shelf 14, retainer ring 26 and base 18 are allowed to be relatively translated from the disassembled state into the operative state and frictionally maintained in that state without the need for separate fasteners. Separate fasteners could be employed to enhance the connection between these elements. It is also contemplated that the shelf 14, retainer ring 26 and base 18 could be aligned in the disassembled state and placed in the operative state without any, or any significant, deformation of any of these elements.

The foregoing disclosure of specific embodiments is intended to be illustrative of the broad concepts comprehended by the invention.

We claim:

1. A stand for supporting articles in an elevated position on a subjacent surface, said stand comprising:

a shelf having a support surface for an article;

a base; and first means cooperating between the base and the shelf for allowing selective placement of the base and the shelf in a) an operative state where the shelf is stably supported on the base without the need for separate fasteners so that the support surface is in an elevated position relative to a subjacent surface on which the base is placed and b) a disassembled state wherein at least part of the shelf is separated from the base, said first means comprising second means for changing the base and the shelf between the operative and disassembled states as the base and the at least part of the shelf are moved relative to each other along a substantially linear predetermined path, said second means comprising a first pair of connecting members on the at least part of the shelf, and a second pair of connecting members on the base, the members of the first pair of connecting members located on the at least part of the shelf to engage against the members of the second pair of connecting members on the base as the base and the at least part of the shelf move along the substantially linear predetermined path from the disassembled state to the operative, the members of one of the first and second pairs having a first orientation relative to each other with the base and the shelf in the disassembled state, and a second orientation relative to each other with the base and the shelf in the operative state, the members of said one of the first and second pairs configured to move from the first orientation to the second orientation as an incident of the members of the first pair engaging against the members of the second pair as the base and the at least part of the shelf move along the predetermined path from the disassembled state to the operative state.

2. The stand for supporting articles according to claim 1, wherein each member of the first pair has a form that is essentially identical to the other member of the first pair.

3. The stand for supporting articles according to claim 1 wherein at least one of the members of the first and second pairs is a post and at least one of the other members of the first and second pairs is a socket for receiving the post.

4. The stand for supporting articles according to claim 3 wherein the post is cylindrical and the socket has an opening defined by a cylindrically-shaped surface.

5. The stand for supporting articles according to claim 1 further comprising:

a retainer ring for confining an article on the support surface of the shelf; and third means cooperating between the retainer ring and the base for allowing the retainer ring and the base to be placed selectively in a) an operative state wherein the ring is located on the base above the shelf without the need for separate fasteners, and b) a disassembled state wherein the retainer ring is separated from the base said third means comprising fourth means for changing the base and the ring between the operative and disassembled states as the base and the ring are moved relative to each other along a second predetermined path, said fourth means comprising a third pair of connecting members on the ring, and a fourth pair of connecting members on the base, the members of the third pair of connecting members located on the ring to engage against the members of the fourth pair of connecting members on the base as the base and the ring move along the second predetermined path from the disassembled state to the operative state, the members of one of the third and fourth pairs having a first orientation relative to each other with the base and the ring in the disassembled state, and a second orientation relative to each other with the base and the ring in the operative state, the members of said one of the third and fourth pairs configured to move from the first orientation to the second orientation relative to each other as an incident of the members of the third pair engaging against the members of the fourth pair as the base and the ring move along the second predetermined path from the disassembled state to the operative state.

6. A stand for supporting articles in an elevated position on a subjacent surface, said stand comprising:

a shelf having a support surface for an article;

a base; and first and second members on the at least part of the shelf, and third and fourth members on the base, the members configured to allow selective placement of the base and the shelf in a) an operative state where the shelf is stably supported on the base without the need for separate fasteners so that the support surface is in an elevated position relative to a subjacent surface on which the base is placed and b) a disassembled state wherein at least part of the shelf is separated from the base, the first member engaged with the third member with the base and shelf in the operative state, one of the first and third members being an elongate post having a lengthwise central axis and the other of the first and third members being a socket having an opening with a central axis, the second member engaged with the fourth member with the base and shelf in the operative state, one of the second and fourth members being an elongate post with a central axis and the other of the second and fourth members being a socket having an opening with a central axis, the central axes of the first and second members with the base and shelf in the disassembled state being one of a) parallel to each other and b) non-parallel to each other, the central axes of the third and fourth members with the base and shelf in the disassembled state being the other of a) parallel to each other and b) non-parallel to each other.

7. The stand for supporting articles according to claim 6 wherein the third and fourth members are sockets.

8. The stand for supporting articles according to claim 6 wherein the posts have a cylindrical shape and the openings are defined by a cylindrical shaped surface.

9. The stand for supporting articles according to claim 6 further comprising:

a retainer ring for confining an article on the support surface of the shelf; and first means cooperating between the retainer ring and the base for allowing the retainer ring and base to be placed selectively in a) an operative state wherein the ring is located on the base above the shelf without the need for separate fasteners and b) a disassembled state wherein the retainer ring is separated from the base.

10. The stand for supporting articles according to claim 9 wherein the first means comprises fifth and sixth members on the retainer ring, and seventh and eighth members on the base, the fifth member engaged with the seventh member in the operative position, one of the fifth and seventh members being an elongate post having a lengthwise central axis and the other of the fifth and seventh members being a socket having an opening with a central axis, the sixth member engaged with the eighth member in the operative position, one of the sixth and eighth members being an elongate post with a central axis and the other of the sixth and eighth member being a socket having an opening with a central axis, the central axes of the sixth and seventh members in the disassembled state being one of a) parallel to each other and b) non-parallel to each other, the central axes of the seventh and eighth members in the disassembled state being the other of a) parallel to each other and b) non-parallel to each other.

11. A stand for supporting articles according to claim 9 wherein the first means comprises fifth and sixth members on the retainer ring, and seventh and eighth members on the base, the fifth member engaged with the seventh member in the operative position, one of the fifth and seventh members being an elongate post having a lengthwise central axis and the other of the fifth and seventh members being a socket having an opening with a central axis, the sixth member engaged with the eighth member in the operative position, one of the sixth and eighth members being an elongate post with a central axis and the other of the sixth and eighth members being a socket having an opening with a central axis, the central axes of the fifth and sixth members in the disassembled state being parallel to each and spaced by a first distance, the central axes of the seventh and eighth members in the disassembled state being parallel to each other and spaced by a second distance, the first and second distances being unequal.

12. A stand for supporting articles in an elevated position on a subjacent surface, said stand comprising:

a shelf having a support surface for an article;

a base; and first and second members on at least part of the shelf, and third and fourth members on the base, the numbers configured to allow selective placement of the base and the shelf in a) an operative state wherein the shelf is stably supported on the base without the need for separate fasteners so that the support surface is in an elevated position relative to a subjacent surface on which the base is placed, and b) a disassembled state wherein at least part of the shelf is separated from the base, the first member engaged with the third member with the base and shelf in the operative state, one of the first and third members being an elongate post having a lengthwise central axis and the other of the first and third members being a socket having an opening with a central axis, the second member engaged with the fourth member with the base and shelf in the operative state, one of the second and fourth members being an elongate post with a central axis and the other of the second and fourth members being a socket having an opening with a central axis, the central axes of the first and second members with the base and shelf in the disassembled state being parallel to each other and spaced by a first distance, the central axes of the third and fourth members with the base and shelf in the disassembled state being parallel to each other and spaced by a second distance, the first and second distances being unequal.

13. The stand for supporting articles according to claim 12 wherein the third and fourth members are sockets.

14. The stand for supporting articles according to claim 12 wherein the first and second members are movable relative to each other transversely to the central axes.

15. The stand for supporting articles according to claim 12 wherein the third and fourth members are movable relative to each other transversely to the central axes of the third and fourth members.

16. The stand for supporting articles according to claim 12 further comprising:

a retainer ring for confining an article on the support surface of the shelf, and first means cooperating between the retainer ring and the base for allowing the retainer ring and base to be placed selectively in a) an operative state wherein the ring is located on the base above the shelf without the need for separate fasteners, and b) a disassembled state wherein the retainer ring is separate from the base.

17. The stand for supporting articles according to claim 16 wherein the first means comprises fifth and sixth members on the retainer ring, and seventh and eighth members on the base, the fifth member engaged with the seventh member in the operative position, one of the fifth and seventh members being an elongate post having a lengthwise central axis and the other of the fifth and seventh members being a socket having an opening with a central axis, the sixth member engaged with the eighth member in the operative position, one of the sixth and eighth members being an elongate post with a central axis and the other of the sixth and eighth members being a socket having an opening with a central axis, the central axes of the fifth and sixth members in the disassembled state being one of a) parallel to each other and b) non-parallel to each other, the central axes of the seventh and eighth members in the disassembled state being the other of a) parallel to each other and b) non-parallel to each other.

18. The stand for supporting articles according to claim 16 wherein the first means comprises fifth and sixth members on the retainer ring, and seventh and eighth members on the base, the fifth member engaged with the seventh member in the operative position, one of the fifth and seventh members being an elongate post having a lengthwise central axis and the other of the fifth and seventh members being a socket having an opening with a central axis, the sixth member engaged with the eighth member in the operative position, one of the sixth and eighth members being an elongate post with a central axis and the other of the sixth and eighth member being a socket having an opening with a central axis, the central axes of the fifth and sixth members in the disassembled state being parallel to each other and spaced by a first distance, the central axes of the seventh and eighth members in the disassembled state being parallel to each other and spaced by a second distance, the first and second distances being unequal.

* * * * *